United States Patent [19]

Yan

[11] 4,052,170

[45] Oct. 4, 1977

[54] MAGNETIC DESULFURIZATION OF AIRBORNE PULVERIZED COAL

[75] Inventor: Tsoung-Yuan Yan, Philadelphia, Pa.

[73] Assignee: Mobil Oil Corporation, New York, N.Y.

[21] Appl. No.: 703,717

[22] Filed: July 9, 1976

[51] Int. Cl.[2] ..... C10L 9/10; C10B 57/00

[52] U.S. Cl. ..... 44/1 R; 201/17

[58] Field of Search ..... 44/1 R; 201/17

[56] References Cited

U.S. PATENT DOCUMENTS

| | | | |
|---|---|---|---|
| 3,463,310 | 8/1969 | Ergun et al. | 209/11 X |
| 3,725,241 | 4/1973 | Chervenak | 208/10 |
| 3,736,233 | 5/1973 | Sass et al. | 201/17 |

*Primary Examiner*—Carl F. Dees

*Attorney, Agent, or Firm*—Charles A. Huggett; Carl D. Farnsworth

[57] ABSTRACT

A process for removing pyrite particles from coal by pulverizing and fluidizing a coal in the presence of (a) heated air, followed by removing pyrite particles with a high-gradient magnetic separator; or (b) a hot, inert gas from which condensables are separated, followed by countercurrently further heating the coal in a succession of fluidized stages with hot oxygen-containing gas to a temperature at which the pyrite particles are sufficiently converted to pyrrhotite, magnetite, and gamma-hematite to raise the average magnetic susceptibility to at least $2 \times 10^6$, and removing the pyrite minerals by magnetic separation means. The beneficiated coal or semicoke particles are fed with heated air and evolve volatile matter to the combustion zone of a furnace.

19 Claims, 6 Drawing Figures

MAGNETIC DESULFURIZATION OF AIRBORNE PULVERIZED COAL

BACKGROUND OF THE INVENTION

1. Field of the Invention

This invention relates to fluid suspension of pulverized solids, and especially relates to magnetic separation of impurities from coal. It specifically relates to the removal of pyrite from coal by thermally enhancing the paramagnetism thereof and separating the pyrite by magnetic means.

2. review of the Prior Art

It is widely acknowledged that the United States is in the midst of a serious energy crisis and that coal must be much more intensively utilized in order to meet future energy requirements, if for no other reason than that coal reserves are far more abundant than reserves of all other non-nuclear fuels combined. However, burning of coal creates air and water pollution which has been the subject of considerable furor in recent years.

Sulfur content of coals used by public utilities for steam and electricity generation ranges from about 1 to 5 percent, so that during 1963 and in recent years, for example, about 5 million tons of sulfur were discharged into the atmosphere, mainly as sulfur dioxide. Sulfur occurs chiefly in three forms: (1) inorganic, (2) sulfate, and (3) organic. The inorganic sulfur is found as iron pyrite ($FeS_2$ in isometric crystalline form), and marcasite ($FeS_2$ in orthorhombic crystalline form), pyrite being more common and being found in coal as macroscopic and microscopic particles and as discrete grains, cavity fillings, fiber bundles, and aggregates.

Although the concentration of pyritic sulfur varies widely even within the same deposit, it normally varies from 0.2 to 3 percent on a sulfur basis. In coals containing more than 2 percent sulfur, about 1 percent is intimately tied up with the structure of the coal as organic sulfur and cannot be removed by mechanical means. Pyritic sulfur, however, can be removed by a variety of separation methods, including wet oil processing and dry methods such as air elutriation, electrostatic separation, and magnetic separation.

As noted by Trindade and Kolm in *IEEE Transactions on Magnetics,* Vol. Mag. 9, No. 3, September 1975, pyrite can be separated from coal in a water slurry flowing through a filamentary magnetic material packed into the bore of a solenoid magnet having a field of 20 kOe, particularly at slurry velocities less than 1 centimeter per second. It is recommended that the nature of the surfaces of the particles be chemically changed in order to generate areas of higher magnetic susceptibility. This advice was followed by Kindig et al, as disclosed in U.S. Pat. No. 3,938,966, by reacting coal particles with iron carbonyl at about 190 C.

The size distribution of pyrite particles in coals ranges from submicron to several millimeters. As disclosed by Ergun and Bean in Report of Investigations 7181 of the United States Bureau of Mines, the particle size of pyrite is logarithmetically equivalent to its weight percentage in a coal bed, each bed having its own characteristic relationship for pyrite particles. For example, on a weight basis, the Pittsburgh Number 8 bed in Ohio has an average particle size of about 50 microns, and the Mammoth bed in Iowa has an average particle size of about 110 microns. It is accordingly evident that coals must be finely pulverized in order to liberate such small particles of pyrite by any mechanical means.

Ergun and Bean further observed that coal particles have a magnetic susceptiblity of about $-0.5 \times 10-6$ in cgs units and are consequently diamagnetic. Pyrite and many other mineral compounds are paramagnetic. In cgs units, pyrite has a magnetic susceptibility of 2800, and both gamma hematite and magnetite have a magnetic susceptibility of 15,600. Consequently, if less than 0.1 percent of pyrite in pyritic coal is converted to paramagnetic compounds of iron, the differential magnetic susceptibilities are sufficiently great that pyrite can be removed from powdered coal by magnetic means without recourse to a high-gradient magnetic field. Ergun et al confirmed that temperatures above the decomposition temperature of coal would be necessary in order to obtain sufficient conversion of pyrite to more magnetic forms and that decomposition reactions become detectable at temperatures well above 500° C and have high energies of activation. They concluded that heating to temperatures above 600° C for a few seconds would be sufficient.

It is known in the art to heat pulverized coal with a heated fluidizing gas and to maintain distillation and coking conditions, as disclosed in U.S. Pat. No. 2,608,526. Recycle gas is used according to U.S. Pat. No. 2,955,077 to fluidize pulverized agglomerative coals and, in a succession of fluidized stages, to dry and preheat the coal at 232°-399° C, to remove about 50% of the volatile matter at 385-441° C for five minutes, and to remove tar vapors at 454°-649° C, using hot char at a weight ratio of 3:1 for heating the pulverized coal. A multi-stage process is also taught in U.S. Pat. No. 3,375,175 in which hot inert gas dries and preheats crushed coal in a fluidized bed at 316°-343° C to remove 0.5-5% oily liquid and water and raise the function temperature sufficiently for subsequent pyrolysis without agglomeration in 3 or more fluidized beds by passing a heated oxygen-containing gas countercurrently.

A process for producing fuel gas, sulfur, and char is additionally disclosed in U.S. Pat. No. 3,736,233 in which sensible heat is provided by inert gas or by char particles; desulfurization is achieved by passing pyrolyzed char, after treatment for up to 20 minutes at 1393°-1343° C, through a highintensity induced-roll magnetic separator. magnetic separation is also used in U.S. Pat. No. 3,463,310 after electromagnetic heating of coal particles to convert pyrite to pyrrhotite, magnetite, or hematite at temperatures on the order of 600° C. A hydrogen-recycle process is discussed in U.S. Pat. No. 3,725,241 for hydrogenating coal under liquid phase conditions in a fluidized reaction zone at a temperature of 399°-510° C, magnetic separation being used at a field strength of about 1000 gauss.

Magnetic separators have long been proposed and used for magnetically separating two or more different substances having differing magnetic susceptibilities. For example, U.S. Pat. No. 689,561 teaches the downward passage of pulverized ores through the flared center of an electromagnet having a pair of opposed pole pieces. U.S. Pat. No. 1,729,008 describes an apparatus for impinging pulverized ores containing paramagnetic and diamagnetic contents onto the surface of a horizontally rotating drum having a stationary magnet therewithin.

What is need for large-scale electrical and steam generation, however, is not the conversion of coal into liquid fuels but the production of a rapidly burning fuel that is easily metered and has not zero sulfur content, with all organic sulfur removed, but a reasonably low content of sulfur, i.e. with most pyrites removed.

Particularly when burning bituminous, high bituminous, and sub-bituminous coals, in which the volatile matter is 35–50 percent by weight on a moisture-free basis, it is necessary to prevent agglomeration thereof while heating to a temperature high enough for enhancing the magnetic susceptibilities of its pyrite contents. It is further desirable to contain and pass along to the furnace combustion zone all evolved volatile matter in admixture with an adequate supply of oxygen for combustion. It is additionally desirable to be able to remove easily distillable oils for combustion purposes or for sale according to economic considerations.

SUMMARY OF THE INVENTION

It is accordingly an object of this invention to provide a process for magnetically separating paramagnetic impurities from pulverized coal in which velocity passing a high-gradient magnetic separator is related to the paramagnetism of the impurities.

It is additionally an object of this invention to provide a process for selectively drying and heating a pulverized coal while distilling oils therefrom.

It is also an object to provide a process for sequential stagewise heating of dried pulverized coal while selectively oxidizing and converting pyrite to highly paramagnetic compounds.

It is finally an object to provide a process for controllably admitting beneficiated pulverized coal, with evolved volatile matter and sufficient air for initial combustion thereof, to the combustion zone of a furnace.

In satisfaction of these objects and in accordance with the principles of the invention, a process is hereinafter described for:

A. pulverizing coal to about 200 mesh while passing a stream of either hot air or heated inert gas therethrough at sufficient velocity to entrain and fluidized the pulverized coal;

B. passing the hot air and entrained coal through a high-gradient magnetic separator means to remove pyritic impurities and form beneficiated coal and feeding the beneficiated coal and the hot air to the combustion zone of a furnace;

C. alternatively, drying with inert gas and separating the dried pulverized coal from the inert gas within a fluidized stage;

D. condensing oily distillate from the inert gas and recirculating the gas, after heating thereof, to the coal being pulverized;

E. successively entraining the dried pulverized coal with a stream of oxygen-containing gas in sequential fluidized stages having successively higher temperatures, while passing the oxygen-containing gas countercurrently thereto, to a final temperature of about 480°–600° C;

F. passing the heated pulverized coal through a high gradient magnetic separator means and magnetically removing iron-containing compounds therefrom to produce a beneficiated coal, and G. entraining the beneficiated coal with hot oxygen-containing gas, which further contains all evolved volatile matter from the sequential fluidized stages, and controllably feeding the beneficiated pulverized coal, the evolved volatile matter, and the oxygen-containing gas to the combustion zone of a furnace.

This process enables all high bituminous and subbituminous coals to be handled without agglomeration thereof and further enables the coal to be raised to a temperature permitting adequate magnetic conversion of a pyrite to paramagnetic forms so that the pyrite can be readily removed by magnetic means at relatively high flow rates. Further, the evolved volatile matter accompanies the low-temperature semicoke in pulverized form to the combustion zone of the furnace.

BRIEF DESCRIPTION OF THE DRAWINGS

As shown in FIG. 1, coal is fed on conveyor belt 11 to a hopper 12 from which it passes through a valve 14 and line 15 to enter a line 55 through which a stream of heated air or a selected mixture of air and flue gas is passing at a temperature of 320°–350° C. The gases and coal enter pulverizing section 20 where the coal is disintegrated by steel balls 21 in pulverizer 22. The velocity of the hot gases is sufficient to entrain coal particles of about 200 mesh, carrying them along through a lengthy drying line 25 to a magneting separating section 30, in which a pair of high-gradient magnetic separators 31, 32 function alternatively.

Figure 1:
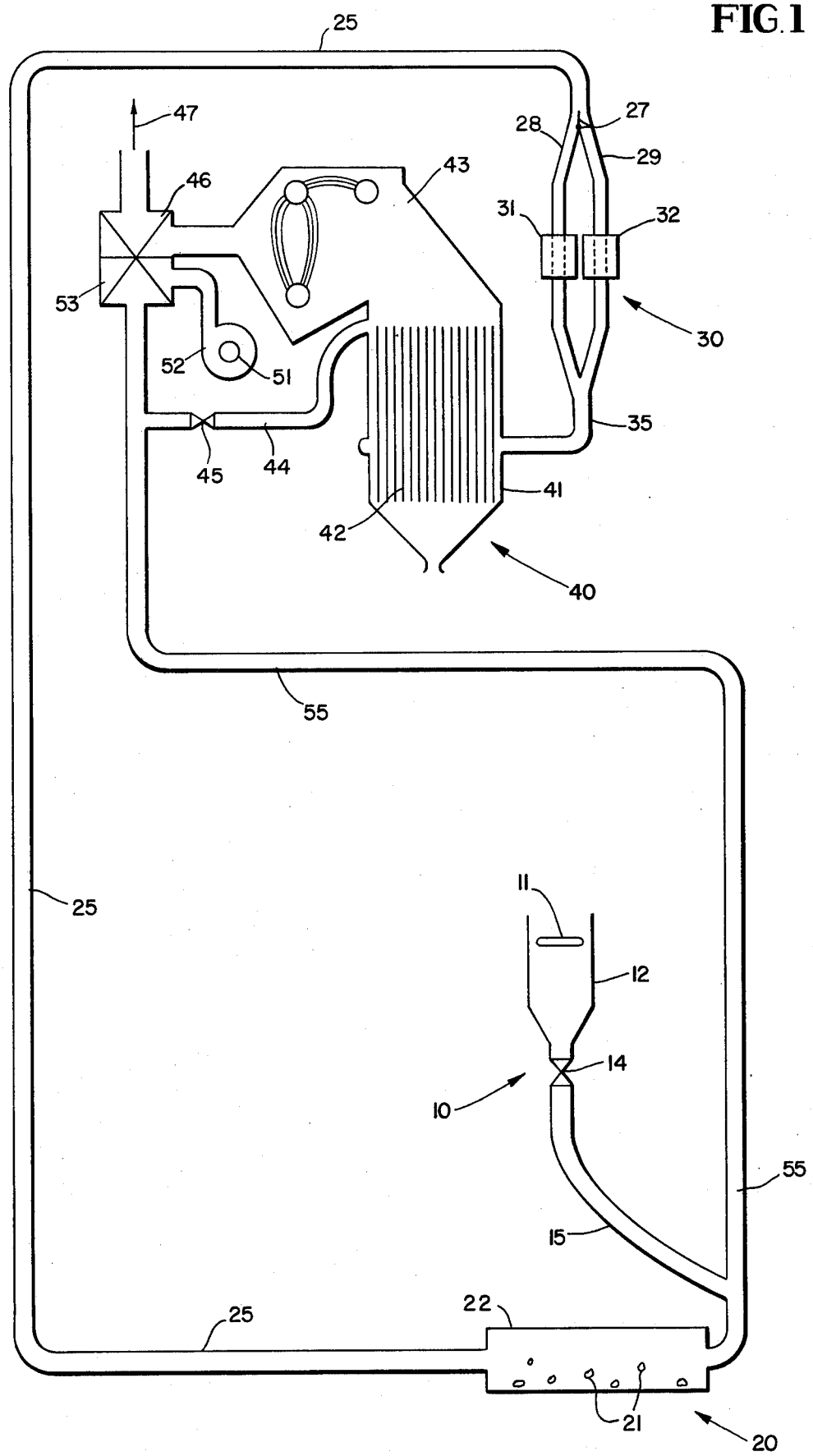
FIG. 1 is a schematic outline of the equipment and flow arrangements for carrying out the process of this invention with heated air.

The flow of gases and coal particles is diverted alternatively through line 28 or line 29 by flap valve 27 to pass through either magnetic separator 31 or magnetic separator 32. Beneficiated coal particles, from which pyrite particles have been removed, pass on to line 35 and then enter furnace section 40.

Within a typical tangentially fired furnace 41, the coal particles and hot gases are fed to combustion zone 42, with secondary air being fed to obtain fast burning rates. The flue gases then pass through the superheater region 43 of the furnace and next move to preheater and economizer 46 from which they pass as stream 47 to the stack.

Figure 2:
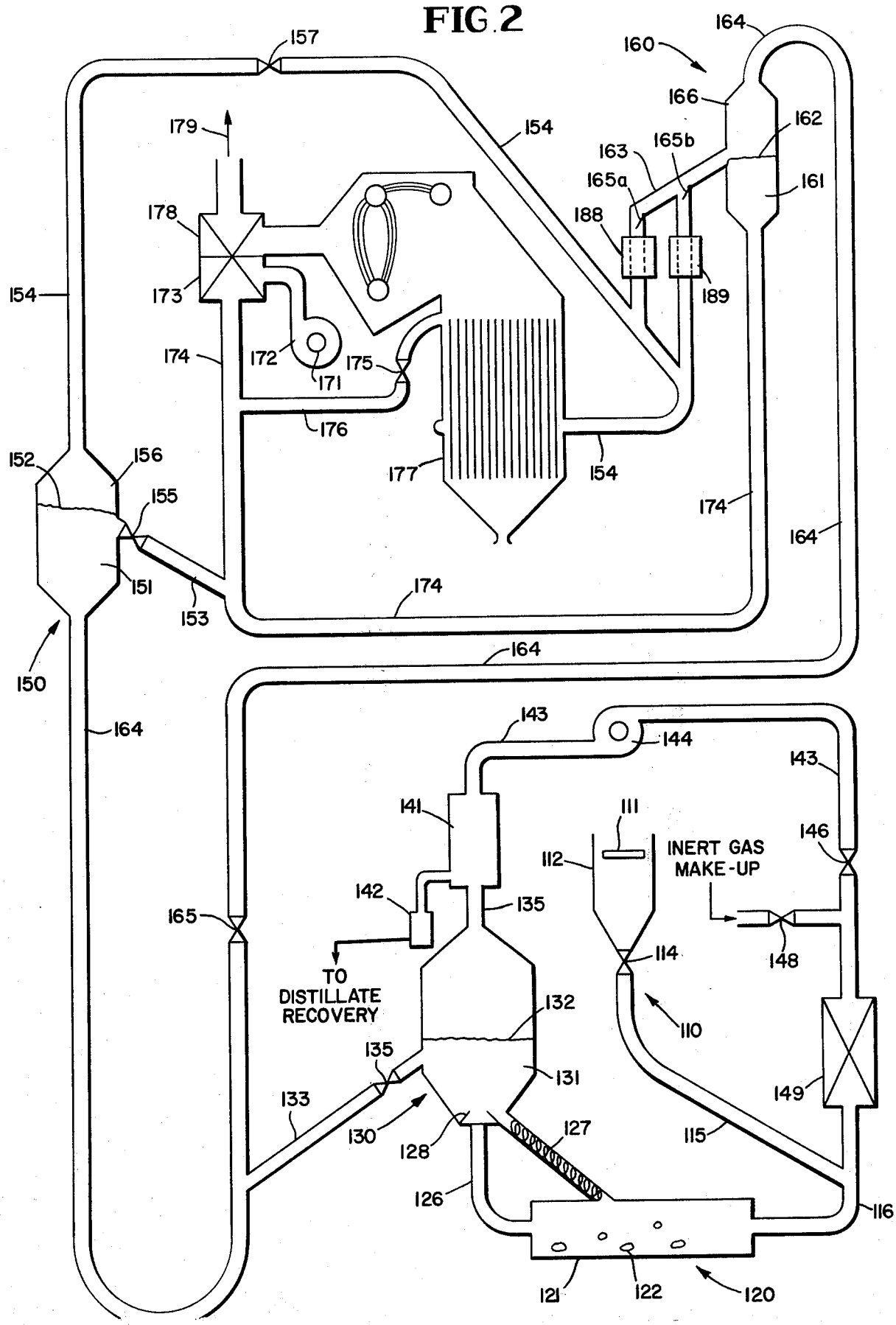
FIG. 2 is a schematic outline of the equipment and flow arrangements for carrying out the process of this invention with flue gas for initial drying and preheating and with a selected mixture of heated air and flue gas for countercurrently heating the pulverized coal in a sequence of fluidized stages before magnetically separating pyrite particles from the coal.

As shown in FIG. 2, pulverized coal enters the plant on a conveyor belt 111 and drops into a hopper 112 from which it passes through a valve 114 and line 115 to enter a line 116 carrying a hot inert gas, such as flue gas, heated in heater 149. The gas and coal enter pulverizer 131 of the pulverizing section 120 where the coal is crushed by rolls 122. The velocity of the gas passing through pulverizer 121 is sufficient to pick up and entrain particles that are approximately 200 mesh in size. The gas and entrained particles pass through line 126 into a preheating stage 130 comprising fluidized bed 131 having a surface 132 within an enlarged vessel 136. Oversized particles are channelled by a bottom return baffle 128 to a screw conveyor 127 for return to pulverizer 121.

In fluidized bed 131, the coal is dried and heated to an upper temperature varying between 315° C and 400° C. The size of the vessel 36 is approximately sufficient to retain the fluidized particles for at least five minutes. The inert gas passing through fluidized bed 131 carries distilled volatile matter with it through line 135 and into condenser 141 where the distilled volatile matter is changed to liquid which drops into vessel 142 from which it passes to distillate recovery. The cooled and stripped inert gas then moves through line 143, blower 144, and valve 146, with make-up inert gas entering through valve 148, to return to heater 149 and continuous recycling through the pulverizer section 120.

A portion of the dried and heated pulverized coal in fluidized bed 131 is continuously withdrawn through line 133 under control of valve 135. Although the level of the top 132 in fluidized bed 131 can be varied by selectively controlling valve 135, so that vessel 136 can function to some extent as a storage vessel, its storage capacity is quite limited and can ordinarily change the retention time within bed 131 by no more than ± 1.5 minutes.

Figure 3:
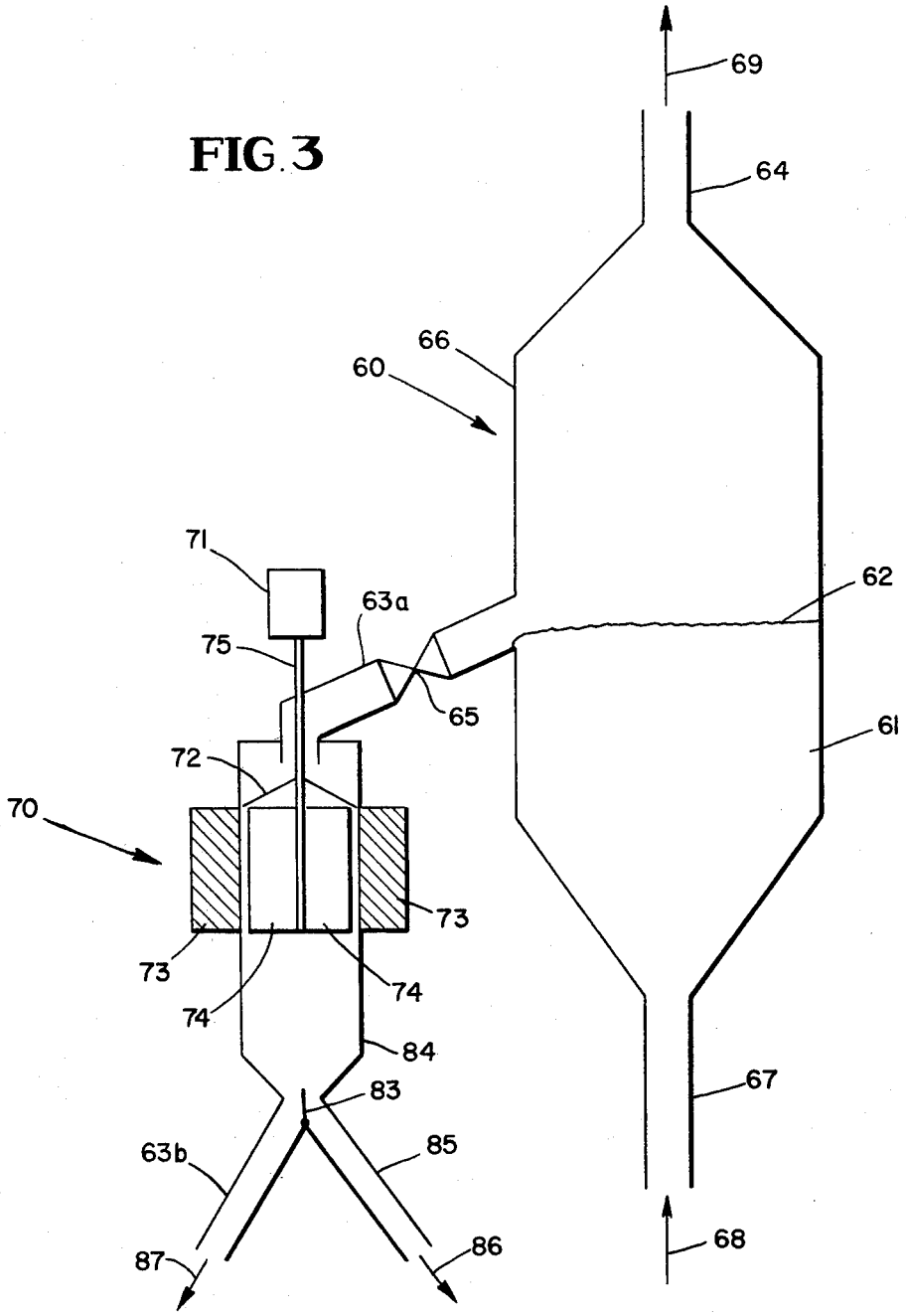
FIG. 3 is a detailed schematic representation of another embodiment of the magnetic separation means which operates intermittently for removal of the iron-containing particles.

The dried and heated particles descending in line 133 are entrained by a hot oxygen-containing gas in line 164 which is controlled by valve 165. The hot gas and coal particles in line 164 then enter the bottom of a vessel 156 which is part of an initial low-temperature carbonization stage 150 for the coal particles. In vessel 156, a fluidized bed 151 has a top surface 152 which is selectively varied by controlling valve 155 through which the partially devolatilized coal particles enter line 153. Additional quantities of hot flue gas, controlled by valve 175, are removed from the combustion or superheater zone of a furnace 177 and are led through line 176 and admixed with the hot air to form a gas mixture having selected proportions of $O_2$ and inert gases. The gas mixture entrains the partially devolatilized coal that is descending in line 153. Ambient air entering intake 171 is compressed by blower 172 and passes through heater 173 to enter line 174. The mixture of flue gas, hot air, and coal particles at about 600° C passes through line 174 to the bottom of an apparatus 166 in the final low-temperature carbonization stage 160. In vessel 166, the coal particles and gas mixture form a fluidized bed 161 having a top level 162. The particles remain in bed 161 for a relatively brief time which varies with the type of coal, 90–120 seconds being generally sufficient. A portion of the heated and devolatilized particles leave bed 161 through line 163 and are alternately directed by flap valves **165*a*, 165*b*, through the cores of high-gradient magnetic separators 188, 189. Iron-containing particles are magnetically removed by a valve and line arrangement which is not shown in FIG. 1 or FIG. 2. This arrangement is sketched, however, in FIG. 6 and is represented by valves 231, 232 and reject lines 233, 234, 235. The concentric apparatus of FIG. 3 is also satisfactory as magnetic separators 188, 189.**

The air passing through bed 161 loses a portion of its oxygen, picks up CO, $CO_2$, $H_2$, and volatilized tars. This mixture passes through line 164 and valve 165 to entrain the dried and heated coal particles moving through line 133. The gases passing through bed 151, which have lost additional oxygen and picked up additional CO, $CO_2$, $H_2$ and volatilized tars, passes through line 154 and valve 157 to entrain beneficiated semicoke particles from which iron-containing particles have been magnetically removed.

The gaseous mixture and the entrained semicoke particles then enter the burners of a water-cooled furnace 177. As in conventional powerplant practice, in line 14 streams of heated auxiliary air are fed to the furnace 177 to mix with the burning semicoke and mixed gases to form an intensely hot turbulent zone within the furnace 177.

The auxiliary line 176 carrying very hot flue gas, under control of valve 175, enables temperature and oxygen content of the gas mixture in line 174 to be independently controlled. The oxygen content of the resultant gas mixture in line 174 should be sufficient to oxidize the pyrite but insufficient to cause substantial combustion of the coal particles. Consequently, even though the particles in bed 161 are at a dull red heat, they do not pass beyond a semicoke condition, and the volatile matter evolved therefrom is in hot gaseous form until the mixture of gases and semicoke particles enter the combustion zone furnace 177. Because a portion of the flue gases are recycled through line 176, the combustion zone of furnace 177 must have a relatively large capacity.

The number of stages that are needed may be varied according to the type of coal. For a Wyoming subbituminous coal having a volatile matter of nearly 50%, the number of low-temperature combination stages that will be necessary to achieve a semicoke condition, as represented in FIG. 2 by stages 150 and 160, would obviously be greater than the number required for a West Virginia bituminous medium volatile coal having 30 percent volatile matter, all on a moisture- and ash-free basis. The criterion for determining the number of stages that is needed is a tendency of the heated coal particles to fuse at a given temperature. Removal of volatile matter raises the fusion temperature of any coal. In general, it is desirable to add stages in the lower temperature range of 350°–450° C.

The field strength in the magnetic separators 188, 189 should be at least 10,000 gauss in order to obtain effective separation of iron-containing minerals at reasonable velocities. Although use of a high-gradient magnetic separator can readily decrease the extent of magnetic enhancement that is needed at a given velocity, it is preferred to utilize high-gradient capability for operation at relatively high flow rates.

The magnetic separators 188, 189 are suitably in the form of a standard rotary or drum device having outer and/or inner magnetizable surfaces that are energized during rotation thereof or intermittently between operational periods for a vane assembly or shaker assembly, respectively, that removes the magnetically segregated particles. It is preferred, however, to utilize a high-gradient magnetic separator having a concentrated magnetic field with a central annular passage.

Specifically, this magnetic separator comprises a vertically disposed tubular member, having a plurality of spaced, vertically aligned vanes attached to the inside surface thereof, and a large diameter ring that is rotatably mounted and is provided with a plurality of inwardly projecting and diametrically opposed pole pieces which are concentrically mounted about the tubular member. Such an apparatus is disclosed in U.S. Pat. No. 3,380,589 for use above a fluidized bed.

It is highly preferred, however, to mount such a concentric apparatus as shown in FIG. 3 for a single stage 60 to which a mixture 68 of fluidizing gases and particles of coal and pyrite flows through line 67, forming bed 61 having surface 62. The particles pass through valve 65 and line 63*a* to enter magnetic separator 70 by impinging upon conical baffle 72 and then dropping along the sides of tubular chute 84. A motor 71 rotates a vertically disposed shaft 75 to which the conical baffle 72 and a plurality of vanes 74 are attached within the chute 84. A plurality of peripherally spaced pole pieces 73 are disposed outside of and rigidly attached to chute 84.

The magnetic separator 70 is operated periodically, by electrically inactivating its pole pieces 73 and discharging beneficiated coal particles as flow 87 through line 63*b*, and is emptied by starting the motor 71 when valve 65 is shut and flap valve 83 is pivoted to shut off line 63*b*. The magnetically attracted particles that are clinging to the walls of chute 84 are dislodged by vanes 74 as pole pieces 73 are electrically inactivated. The dislodged material falls as flow 86 through line 85 to a pyrite recovery bin.

The inactivation period is brief and is followed by closing of line 85 with flap valve 83, activation of pole pieces 73, and opening of valve 65. Gases depart as flow 69 through line 64. Because the period of operation of magnetic separator 70 is several times as great as the period of inactivation thereof, a single magnetic separator 70 is adequate for handling the output of fluidized stage 60.

Figure 4:
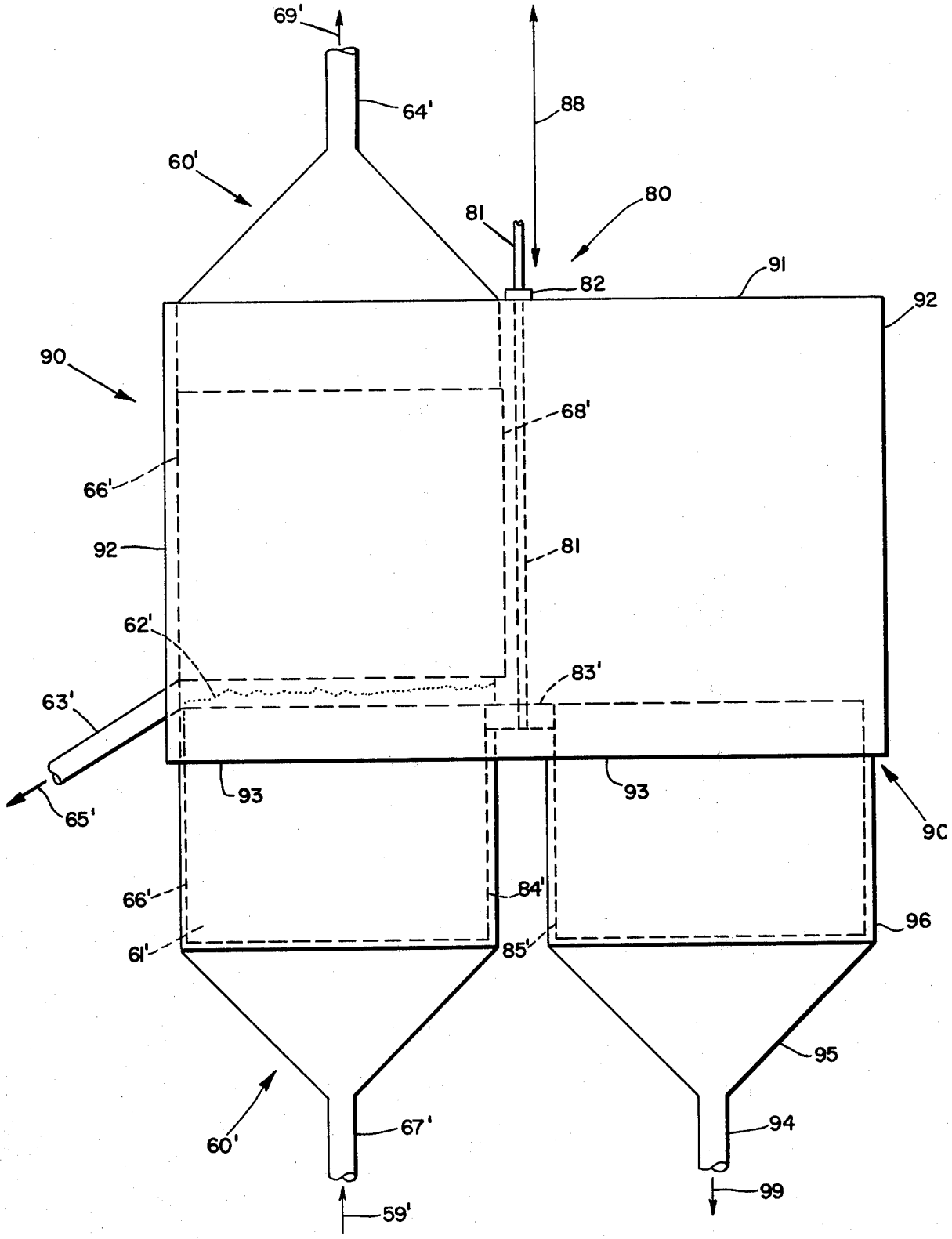
FIG. 4 is a schematic representation of an apparatus containing the final fluidized stage and a magnetic separation means operating within the fluidized bed which can be elevated and rotated for removal of magnetically bound, iron-containing particles.
Figure 5:
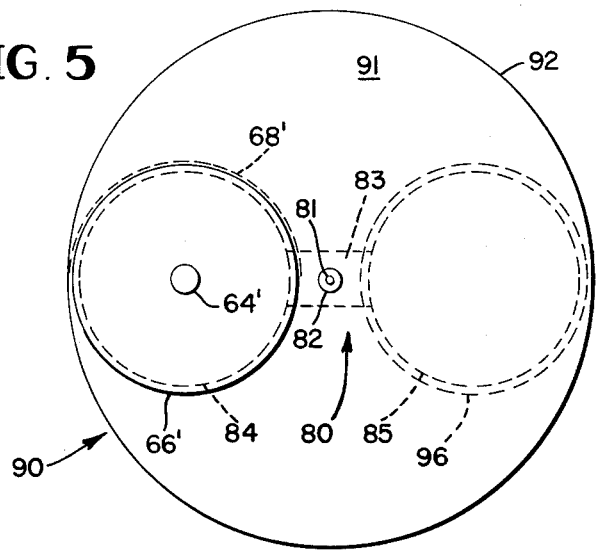
FIG. 5 is a top view of the apparatus shown in FIG. 4.

In FIGS. 4 and 5, a magnetic separator 80 is shown in combination with a fluidized stage 60'. The separator 80 is submerged in a fluidized bed having upper level 62' within a vessel 66'. A mixture 59' of gases and coal particles enters the vessel 66' through line 67'. The bed 61' is drained by line 63'. An entire semi-cylindrical upper side of vessel 66' is open. A semicylindrical shield 68' selectively covers this upper side of vessel 66'.

The magnetic separator 80 comprises a vertical shaft 81 which is seated within a bearing 82 and is attached to a base 83' to which are attached a pair of drum-shaped magnets 84', 85' having means for attracting particles on both inner and outer surfaces, and comprising interior packing of steel wool or wire screens.

The magnetic separator 80 further comprises an elevator means (not shown in FIGS. 4 and 5) that enables the shaft 81 to be vertically raised and lowered through distance 88.

The vessel 66' is within and attached along its bottom half to a discharge means 90 comprising a large, shallow vessel having a top 91, sides 92, bottom 93, and a diameter slightly greater than twice the diameter of vessel 66'. A cylindrical vessel, having a conical bottom 95, sides 96, and a distance line 94 is also attached and connected to the bottom 93 of the large vessel. Exit line 64', above bed 61', is attached and connected to the top 91 of the shallow cylindrical vessel and the bearing 82 is also centrally located in the top 91. The magnetic separator 80 operates by elevating the shaft 81 through distance 88, revolves the magnetic separator drums 84', 85' through 180°, and lowering the shaft 81 through distance 88. While one of the drums 84', 85' is magnetically operating, the other of the drums 84', 85' is electrically inactivated and is discharging its contents of pyrite impurities to line 94. Shield 68' is lowered to enable the drums 84', 85' to be revolved and is then raised to close the vessel 66' and allow fluidized operation therewithin.

A mixture of coal particles, pyrite particles, and gas enters stage 60' as flow 59'. Beneficiated semicoke particles depart as flow 65' through line 63'. Gases depart through line 64' as flow 69'. Pyrite impurities depart through line 94 as flow 99.

Figure 6:
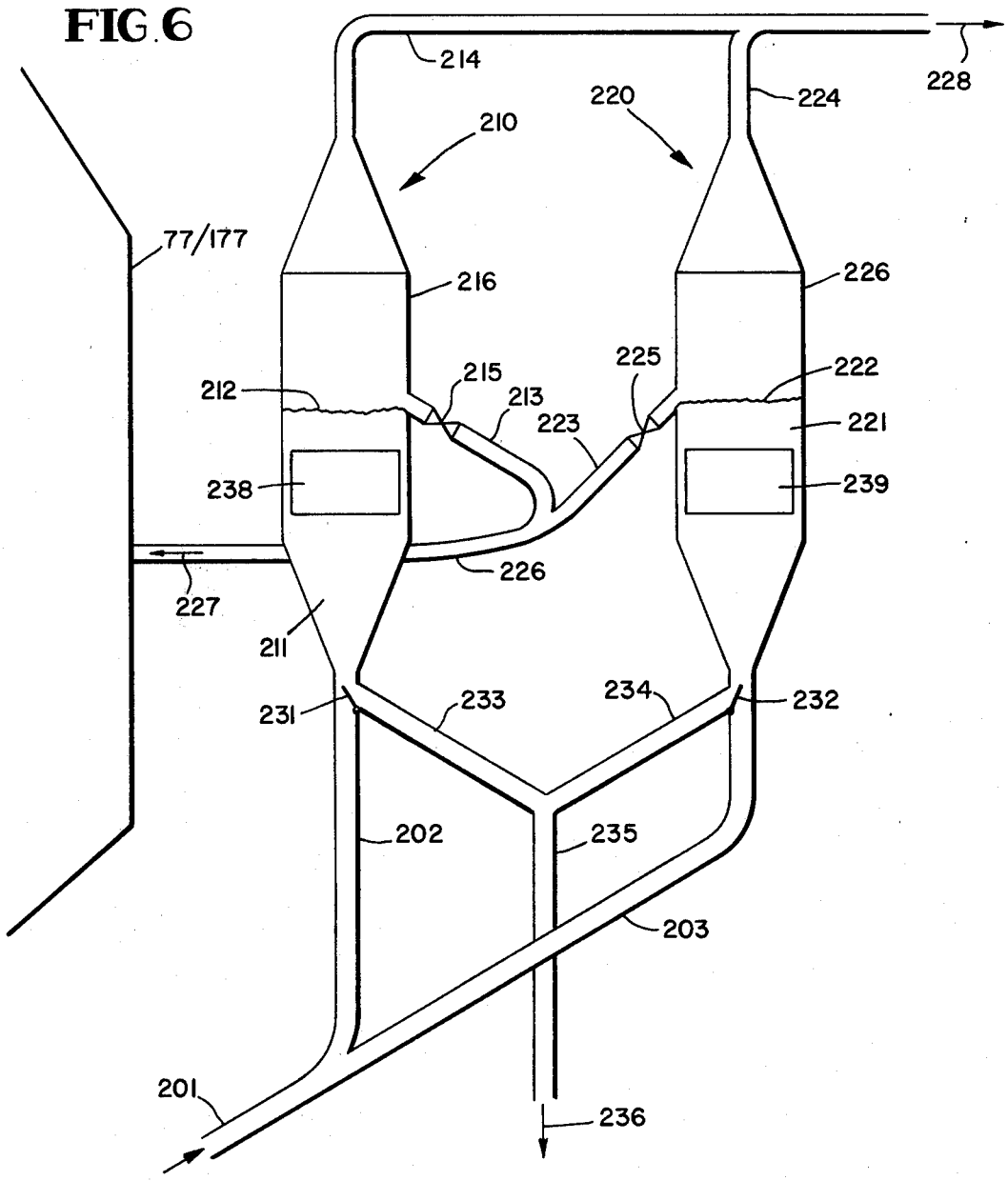
FIG. 6 is a schematic representation of an apparatus in which the fluidized stage is in tandem with a separate magnetic separation means within the fluidized bed of each unit for alternate operation and removal of magnetically attracted iron-containing particles.

Vessel 216 of stage 210 is shown in FIG. 6 in combination with a similar vessel 226 of stage 220. Discharge lines 213 and 223, respectively controlled by valves 215 and 225, are Y-connected, thus enabling beneficiated semicoke particles 227 to enter the combustion zone of a furnace 77 or 177 by line 226. Vessels 216 and 226 are fed by feed lines 202 and 203. Valves 231 and 232 respectively, shut off feed lines 202 and 203, permitting material to pass through lines 233 and 234, which are Y-connected to form discharge line 235.

The stages 210 and 220 as represented in FIG. 6 are alternatively operated. While one magnetic separator, such as magnetic separator 238 in fluid bed 211, is in operation, flap valve 232 to line 203 is closed, thus opening line 234. Magnetic separator 239 is electrically inactivated, and magnetically attracted material is discharged into line 234 and line 235 to sulfur recovery as flow 236. When magnetic separator 238 has filled up, it is inactivated, valve 231 is closed to line 202, and valve 232 is closed to line 234. The feed in line 201 is then shuttled through line 203 to form bed 221 in vessel 226. Exit gases cease to pass through line 214 and instead emerge through line 224 as flow 228. This apparatus consequently permits substantially continuous operation of the final fluidized stage for low-temperature carbonizing by means of two vessels 216 and 226, having magnetic separators 238 and 239, which are controlled by a valve-and-line system 231, 232, 233, 234, 235.

By operating this process on high-volatile coals, up to 10 percent of the moisture and ash-free weight of the coal can be obtained as condensed oils which can be used for fuel or can be separately marketed accordingly to economic considerations. Most of the pyrites can be magnetically removed and sent to sulfur recovery, thereby considerably reducing the ash content of the coal. A portion of the required heat is generated within each of the fluidized stages according to the oxygen content of the heated air, but most of the combustion occurs within the combustion zone of the furnace. Because a large part of the volatile matter is already in gaseous form, combustion within this zone is very rapid indeed and the amount of ash that is produced is reduced.

A preferred configuration of the magnetic separator is a steel canister fitted with steel screens. Preferably, the steel screens are in parallel across the interior of the canister, are spaced about one centimeter apart, and are 20–60 mesh. Each canister is preferably equipped with, or attachable to while in its discharging state, a shaking device that rapidly removes magnetically attracted particles.

Exhaust process steam is preferably fed to the mixtures of heated air and coal particles prior to entering each fluidized stage in order to control the relative humidity of the heated air before the mixtures enter one of the fluidized stages, thus minimizing build-up of static electric charges and agglomeration of the particles.

Because it will be readily apparent to those skilled in the art that innumerable variations, modifications, applications, and extensions of these embodiments and principles can be made without departing from the principles and scope of this invention, what is herein defined as such scope and is desired to be protected, including such departures from the present disclosure as come within known or customary practices in the art to which the invention pertains, should be measured, and the invention should be limited, only by the following claims.

What is claimed is:

1. A method for producing a rapidly burning fuel for large-scale electrical and steam generation by:

A. preheating a coal, having a high content of inorganic sulfur and 35–50 percent by weight of volatile matter on a moisture-free basic, to a temperature high enough to enhance the magnetic susceptibility of said inorganic sulfur, while preventing agglomeration of said coal and while selectively retaining said volatile matter as a portion of said rapidly burning fuel, by:

1. disintegrating said coal to about 200 mesh to form pulverized coal while passing a stream of heated gas therethrough at sufficient velocity to entrain and fluidize said pulverized coal,
2. drying said pulverized coal and separating the dried coal from said heated gas within a fluidized stage to form dried pulverized coal, and
3. successively entraining said dried pulverized coal with a stream of hot oxygen-containing gas in sequential fluidized stages having successively higher temperatures, while passing said oxygen-containing gas countercurrently thereto, so that said dried pulverized coal is subjected to a final temperature of about 480°–600° C. and said inorganic sulfur has enhanced magnetic susceptibility;

B. magnetically removing at least a portion of said inorganic sulfur having enhanced magnetic susceptibility by passing said dried pulverized coal through a magnetic separator means to produce a beneficiated coal; and C. entraining said beneficiated coal with a mixed oxygen-containing gas, which selectively contains all evolved volatile matter from said sequential fluidized stages, and controllably feeding said beneficiated coal, said evolved volatile matter, and said mixed oxygen-containing gas, as said rapidly burning fuel, to the combustion zone of a furnace used for said large-scale electrical and steam generation.

2. The method of claim 1, wherein said high-gradient magnetic separator has a field strength of at least 10,000 gauss.

3. The method of claim 2, wherein said high-gradient magnetic separator is a canister fitted with steel screens.

4. The method of claim 3, wherein two of said canisters are used in parallel, and the flow of said pulverized coal is swung from one canister to the other to permit said one canister to be discharged.

5. The method of claim 4, wherein a part of said hot air passes through said one canister being discharged and then through a cyclone separator before said entraining said pulverized coal.

6. A method for (a) preheating bituminous, high bituminous, and sub-bituminous coals having a high content of pyritic sulfur to a temperature high enough for enhancing the magnetic susceptibilities of said pyritic sulfur while preventing agglomeration of said coals, (b) magnetically removing at least a portion of said pyritic sulfur from said coals to form beneficiated coals, and (c) controllably admitting said beneficiated coals, with at least a remaining fraction of evolved volatile matter and sufficient combustion air, to the combustion zone of a furnace as a rapidly burning fuel that is easily metered and has a reasonably low content of sulfur, comprising:

A. forming a dried pulverized coal and an oily distillate within a closed cycle for a heated inert gas by the following steps:

1. disintegrating a coal containing pyritic sulfur to about 200 mesh to form a pulverized coal while passing heated inert gas therethrough at sufficient velocity to entrain and fluidize said pulverized coal,
2. drying said pulverized coal, partially distilling volatile matter therefrom, and separating said pulverized coal from said inert gas within a fluidized stage, and
3. condensing said partially distilled volatile matter from said inert gas to form said oily distillate and recirculating said inert gas, after heating thereof to form said heated inert gas, to the coal being disintegrated; and B. forming said rapidly burning fuel within a countercurrent cycle for a heated oxygen-containing gas by the following steps:

1. successively entraining said pulverized coal with a stream of heated oxygen-containing gas in sequential fluidized steps having successively high temperatures while passing said oxygen-containing gas countercurrently thereto, so that said pulverized coal is subjected to a final temperature of about 480°–600° C that enhances said magnetic susceptibilities of said pyritic sulfur,
2. passing said pulverized coal through a magnetic means and magnetically removing said at least a portion of said pyritic sulfur therefrom to produce a beneficiated coal, and
3. entraining said beneficiated coal with cooled oxygen containing gas, which contains said at least a remaining fraction of evolved volatile matter from said sequential fluidized stages, and controllably feeding said beneficiated pulverized coal, said evolved volatile matter, and said oxygen-containing gas to the combustion zone of a furnace.

7. The method of claim 6, wherein said stream of oxygen-containing gas is a mixture of heated air and flue gas.

8. The method of claim 7, wherein said mixture is selectively adjusted to contain a selected proportion of oxygen which is sufficient for oxidizing said pyritic sulfur but insufficient for combusting said coal.

9. The method of claim 6, wherein said magnetic means is a high-gradient magnetic separator.

10. The method of claim 9; wherein said high-gradient magnetic separator has a field strength of at least 10,000 gauss.

11. The method of claim 6, wherein said sequential fluidized stages comprise at least two low-temperature carbonization stages.

12. The method of claim 11, wherein said low-temperature carbonization stages comprise an initial low-temperature carbonization stage at 400°–500° C and a final low-temperature carbonization stage at 500°–600° C.

13. The method of claim 12, wherein the temperatures of said initial low-temperature carbonization stage and said final low-temperature carbonization stage are varied to obtain maximum enhanced magnetic susceptibility of said pyritic sulfur.

14. The method of claim 13, wherein said pyritic sulfur having maximum enhanced magnetic susceptibility and said pulverized coal pass at maximum velocity that permits adequate recovery of said at least a portion of said enhanced pyritic sulfur through said magnetic means.

15. The method of claim 14, wherein said magnetic means is operated intermittently.

16. The method of claim 15, wherein said magnetic means is a single magnetic separator which is intermittently operated in combination with a valve means for separately removing magnetically attracted pyritic sulfur.

17. The method of claim 15, wherein said magnetic means is a pair of magnetic separators that are alternately operated.

18. The method of claim 15, wherein said magnetic means is a pair of magnetic separators that are lifted, revolved, and lowered into operating and discharging positions.

19. The method of claim 6 wherein said at least a remaining fraction of evolved volatile matter is all of said evolved volatile matter and none of said partially distilled volatile matter is recovered as said oily distillate.

* * * * *

UNITED STATES PATENT AND TRADEMARK OFFICE

CERTIFICATE OF CORRECTION

PATENT NO. : 4,052,170

DATED : October 4, 1977

INVENTOR(S) : TSOUNG-YUAN YAN

It is certified that error appears in the above-identified patent and that said Letters Patent are hereby corrected as shown below:

| | |
|---|---|
| Column 1, line 55 | "190 C" should be --190°C--. |
| Column 2, line 2 | "-0.5 x 10-6" should be --0.5 x $10^{-6}$--. |
| Column 2, line 35 | "function" should be --fusion--. |
| Column 2, line 44 | "highintensity" should be --high-intensity--. |
| Column 2, line 45 | "separator. magnetic" should be --separator. Magnetic--. |
| Column 4, line 66 | "131" should be --121--. |
| Column 6, line 9 | "line 14" should be --line 154--. |

UNITED STATES PATENT AND TRADEMARK OFFICE

CERTIFICATE OF CORRECTION

PATENT NO. : 4,052,170

DATED : October 4, 1977

INVENTOR(S) : TSOUNG-YUAN YAN

It is certified that error appears in the above-identified patent and that said Letters Patent are hereby corrected as shown below:

Column 7, line 57 "distance" should be --discharge--.

Column 10, line 27 "fluidized step" should be --fluidized stages--.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*